United States Patent [19]

Stadjuhar et al.

[11] Patent Number: 4,680,883

[45] Date of Patent: Jul. 21, 1987

[54] SCROLL MODULE AND SIGN SYSTEM FOR INTERNALLY ILLUMINATED SIGNS

[75] Inventors: Robert C. Stadjuhar; Cecil S. Renfro, both of Colorado Springs, Colo.

[73] Assignee: Skyline Products, Inc., Colorado Springs, Colo.

[21] Appl. No.: 746,185

[22] Filed: Jun. 18, 1985

[51] Int. Cl.[4] ..... G09F 11/18

[52] U.S. Cl. ..... 40/471; 40/467; 40/483; 40/518

[58] Field of Search ..... 40/471, 467, 478, 483, 40/518, 520, 117; 242/155

[56] References Cited

U.S. PATENT DOCUMENTS

| | | | |
|---|---|---|---|
| 625,844 | 5/1899 | Kelso, Jr. et al. | 40/518 |
| 1,430,394 | 9/1922 | McGee | 40/471 |
| 1,711,850 | 5/1929 | Lake | 40/518 |
| 1,741,092 | 12/1929 | Blake | 40/471 |
| 2,328,055 | 8/1943 | Clough | 40/471 |
| 2,650,713 | 9/1953 | Nigh | 242/155 R |
| 2,729,006 | 1/1956 | Olsson | 40/471 |
| 2,764,826 | 10/1956 | Fulton et al. | 40/518 |
| 3,510,973 | 5/1970 | Mazzocco, Sr. | 40/471 |
| 3,780,458 | 12/1973 | Jacoby et al. | 40/471 |
| 4,375,730 | 3/1983 | Sanders et al. | 40/518 |

FOREIGN PATENT DOCUMENTS

| | | | |
|---|---|---|---|
| 146571 | 12/1903 | Fed. Rep. of Germany | 40/520 |
| 362332 | 10/1922 | Fed. Rep. of Germany | 40/471 |
| 2334162 | 7/1977 | France | 40/518 |
| 408227 | 4/1934 | United Kingdom | 40/467 |
| 2131218 | 6/1984 | United Kingdom | 40/471 |

*Primary Examiner*—Robert Peshock
*Assistant Examiner*—Cary E. Stone
*Attorney, Agent, or Firm*—Timothy J. Martin

[57] ABSTRACT

A scroll apparatus formed as a box-like framework with a front view area which houses a pair of rollers upon which a message web is wound in a scroll manner such that an exposed portion of the web extends between the rollers along the view area. A drive strap has each of its opposite ends fixed to a respective roller with its respective end portions each wrapped about itself in a circumferential direction opposite the direction that the message web is wound about the associated roller. The drive strap and web thus form a loop drive assembly for the rollers. Tensioning structure is provided for the drive assembly to keep the web taut and to remove slack due to variations in winding diameters. A color panel is positioned adjacent the message web on a side thereof opposite the view area, and the apparatus is internally lit so that the message web is illuminated by light passing through the color panel. Several apparatus, in modular form, may be used to construct a larger display sign.

27 Claims, 12 Drawing Figures

SCROLL MODULE AND SIGN SYSTEM FOR INTERNALLY ILLUMINATED SIGNS

BACKGROUND OF THE INVENTION

The present invention relates to internally illuminated outdoor signs, and particularly to a sign system incorporating a scroll module adapted to display a message selected from a plurality of messages on a message web. While directed to an internally illuminated sign, the scrolling apparatus used in the display module can be used without the internal illumination for general message display and advertising purposes.

The use of message scrolls, wherein a message web is wound between two cylinders, has been known since ancient scribes recorded the events of their times. In more modern times, the scroll system has been adapted for mechanical operation in order to display messages contained thereon. For example, U.S. Pat. No. 1,024,044, issued Apr. 23, 1912 to Tucker, discloses a scroll assembly having a message web wound on a pair of message rollers that are driven by a gear system with the message web being trained across two display stations. U.S. Pat. No. 1,547,495, issued July 28, 1925 to Galley, discloses an advertising apparatus incorporating three message rollers with one message roller receiving message webs from each of the other two rollers. In this system, a drive cord is provided and an idler wheel bears against the cord to maintain tension on the roller assembly.

In U.S. Pat. No. 3,616,554, issued Nov. 2, 1971 to Finger et al, a pair of independent motors operate a respective message rollers so that a message web may be trained between a support surface and viewing face. U.S. Pat. No. 4,205,801, issued June 3, 1980 to Decaux, discloses a band winding device wherein a message band is wound on a pair of spaced apart, parallel rollers. The rollers are driven by an endless chain and sprocket drive with a drive motor directly engaging the chain. To compensate for changes in radial dimensions as the band is wound from one roller to another, the drive chain has two looped portions with each looped portion being trained around a pulley mounted on a moveable carriage. A weight is suspended around a third pulley on the moveable carriage to apply a substantially constant gravitational force on the drive chain.

Many of the prior art scrolling assemblies have, however, been fairly complicated in structure and expensive to manufacture and maintain. Due to the complexity of the assemblies, especially where gear driven systems are provided, these units may experience a relatively high rate of breakdown which decreases their usefulness, especially in locations that are difficult to access. A problem has been experienced by many prior art assemblies in that the message web tends to drift laterally of the view opening; also, the message web may lose its tension and sag. Further, due to the internal structure of these devices, the prior art scroll assemblies are difficult to illuminate interiorly so that illumination of the message band requires an external light source which can diminish the practicality of the systems.

Accordingly, there is a need for a relatively low maintenance scroll apparatus that is simple in construction yet reliable in operation. There is a further need for such a scroll apparatus module that may be internally illuminated and which may be used along or in combination with other modules to form a display sign that is particularly adapted to be used at locations having relatively difficult access.

SUMMARY OF THE INVENTION

It is an object of the present invention to provide a scrolling apparatus that may be constructed in module form and that has a simple, useful scroll drive assembly.

It is another object of the present invention to provide a scrolling apparatus, in modular form, that is simple in construction and reliable in operation and which may be internally illuminated so as to eliminate external light sources.

It is still a further object of the present invention to provide a scrolling apparatus for a message web that is wound on a pair of scrolling rollers such that a selected message is guided to a desired location and maintained in a taut, neat manner.

These objects are accomplished by the scroll apparatus and drive assembly according to the preferred embodiment of the present inventio. In its broadest form, the present invention comprises a module adapted to be mounted in a display sign and constructed as a box-like framework having an open front face that allows external viewing of a selected message. A pair of rollers are located at opposite sides interiorly of the framework and are journaled for rotation on substantially parallel spaced-apart axes. The pair of rollers supports a flexible message web which has its opposite ends secured to a respective roller and which has opposite end portions wound around the rollers so that an exposed portion of the web extends between the rollers along the front face. Rotation of the rollers causes the web to be wound from one roller to another in order to change the exposed portion thereof. A flexible drive strap has a first end secured to one of the rollers and a second end secured to the other rollers such that the drive strap has end portions wound around the rollers ina circumferential direction opposite the winding of the message web. As the rollers turn, the drive strap is wound from one roller to the other and is wrapped about itself on the respective rollers. To this end, the strap has a width substantially larger than its thickness and a tensioning mechanism is provided to compensate for variations in the diameter of the wrapped drive strap and the wrapped message web. A drive motor is employed either to directly drive the drive strap or to drive one of the rollers in a reversible manner so that the web may be reversibly wound from one roller to the other.

In the preferred embodiment of the present invention, several modules may be mounted in a display sign or alternatively on opposite sides of an open housing that contains a light source. Each module is constructed identically, and each preferably includes a guide assembly for the message web as well as an indexing and automatic sensing apparatus to automate operation of the scroll mechanism. A translucent color panel is resiliently mounted in each module and covers most of the exposed portion of the web. the message web has transparent characters on a substantially opaque background so that the character displayed takes on the color of the color panel. The color panel may be enhanced for ultraviolet response to increase visibility during daylight.

Preferably, the tensioning system for the message web comprises a looped portion of the drive strap which extends around a pulley that freely floats with respect to the module's framework. This freely floating pulley is only connected to the framework by means of a cable and biasing spring which tends to lengthen the loop to maintain tension on the rollers. The drive motor may either directly drive the drive strap or may drive one of the rollers through a drive belt.

These and other objects of the present invention will become more readily appreciated and understood from a consideration of the folowing detailed description of the preferred embodiment when taken together with the accompanying drawings, in which:

DETAILED DESCRIPTION OF THE PREFERRED EMBODIMENT

The present invention is directed to a display apparatus, preferably in the form of an outdoor sign, that has a changeable message. The present invention is particularly adapatable to display messages that need to be changed from time to time. For example, the display apparatus described herein is useful to display prices, such as gasloine prices, which typically fluctuate over short time periods. The present invention is constructed to be an internally lit display incorporating one or more scroll modules having a novel and useful drive and tensioning mechanism so that the message surface is maintained in an aligned, taut manner.

Figure 1:
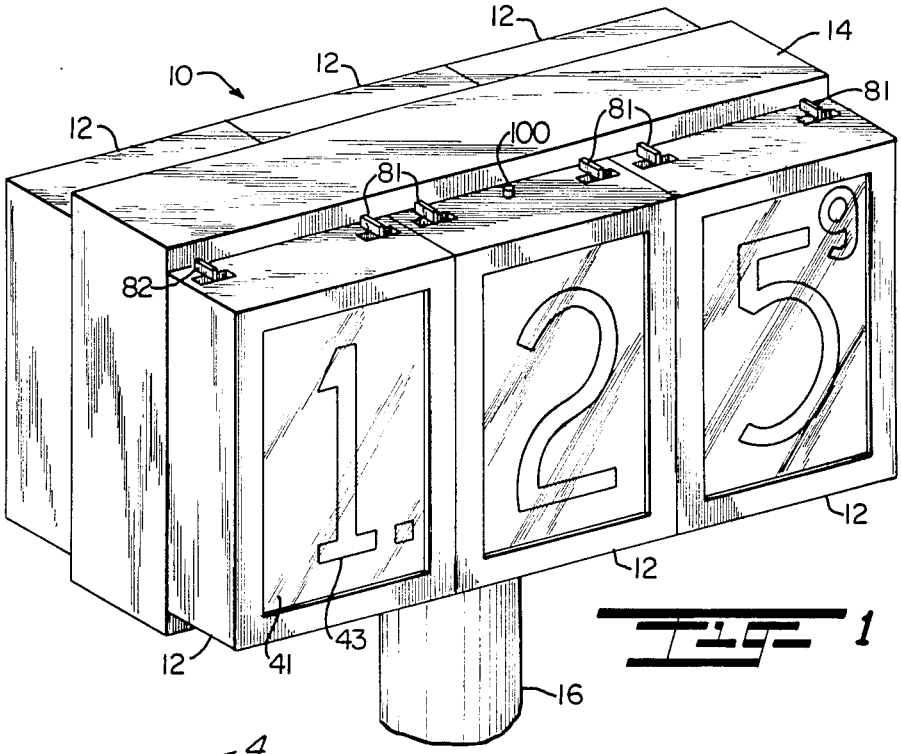
FIG. 1 is a perspective view of a display sign incorporating modules according to the preferred embodiment of the present invention.

The preferred embodiment of the present invention is incorporated in display sign 10 shown in FIG. 1 wherein a plurality of scroll modules 12 are mounted on a central housing 14 that is supported by pole 16. It should be appreciated that sign display 10 incoporates a plurality of modules 12. However, the general form of the preferred embodiment of the present invention comprises each module 12 since these modules stand as individual message display units.

Accordingly, a module 12 according to the preferred embodiment of the present invention is best shown in FIGS. 2–5 includes framework 18 formed out of sheet metal as top wall 20, bottom wall 22, side wall 24 and side wall 26. Module 12 has an open back 28 and a front face 30 formed of a transparent material to define a viewing area for a selected message. Module 12 thus has a box-like construction and supports a pair of scrolling rollers 32 and 34 therein.

Rollers 32 and 34 are rotatably journaled in framework 18 on spaced-apart substantially parallel axes, as defined by pairs of trunnion pins 33 and 35, and receive a flexible message web 36 that carries the desired message, such as letters, numbers or other messages, for viewing through front face 30. Preferably, web 36 is constructed of a flexible plastic material that forms an opaque backgrond 41 for a translucent message 43, such as numeral "1" in FIG. 1. Message web 36 has its opposite end edges attached to rollers 32 and 34, respectively, with its end portions 38 and 40 being wrapped around rollers 32 and 34, respectively so that web 36 may be advanced from one roller to another. An exposed portion 42 of web 36 extends between rollers 32 and 34 along front face 30 with exposed portion 42 thus carrying a selectively changeable message for display through front face 30. A color panel 44 is adjacent exposed portion 42 so that portion 42 is located between panel 44 and transparent front face 30 and is held in position therebetween.

Message web 36 is reversibly advanced by rotation of the rollers 32 and 34 since the web is wound from one roller to the other. To this end, rollers 32 and 34 are rotated by a drive strap 46 which s preferably in the form of a stainless steel band having a width substantially larger than its thickness. Strap 46 has one end fixedly secured to roller 32 and has end portion 45 wrapped around roller 32 in circumferential direction opposite the wrapping of web 36 on roller 32. An opposite end of strap 46 is fixedly secured to roller 34 and has end portion 47 wrapped therearound in a circumferential direction opposite that of web 36 around roller 34. Thus, strap 46 and web 36 form a closed loop drive system to reversibly rotate rollers 32 and 34. In order to drive rollers 32 and 34, then, strap 46 includes a first looped portion 48 that is trained around a drive wheel 50 which is connected to drive shaft 51 of motor 52. A second looped portion 54 of strap 46 extends around a tension pulley 56 that is rotatably journaled on axle 57 of freely floating pulley bracket 58.

Figure 2:
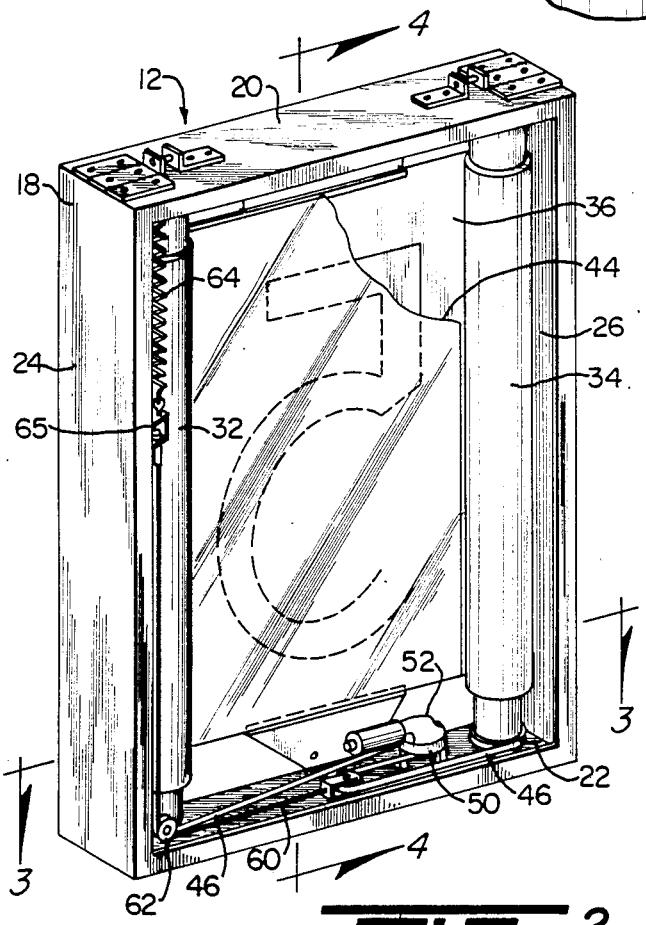
FIG. 2 is a perspective rear view of a scroll module according to the preferred embodiment of the present invention.

Bracket 58 freely floats with respect to framework 18 but is subjected to a tensioning force by cable 60. Specifically, cable 60 is attached at one end to bracket 58 and extends around pulley 62 to be attached at its opposite end to a spring 64, through adjustable screw 65 as is shown in FIG. 2, with spring 64 then being attached to framework 18. Spring 64 places tension on cable 60 so that the tensioning force on bracket 58 tends to lengthen looped portion 54. Screw 65 allows the tensioning force to be selectively adjusted. Since motor 52 is rigidly secured to framework 18 and since drive wheel 50 directly engages strap 46, this tensioning force tends to rotate roller 34; however, since drive wheel 50 is stationary, roller 32 is frictionally "locked" against rotation. Accordingly, this tensioning force keeps exposed portion 42 of message web 36 taut.

Figure 4:
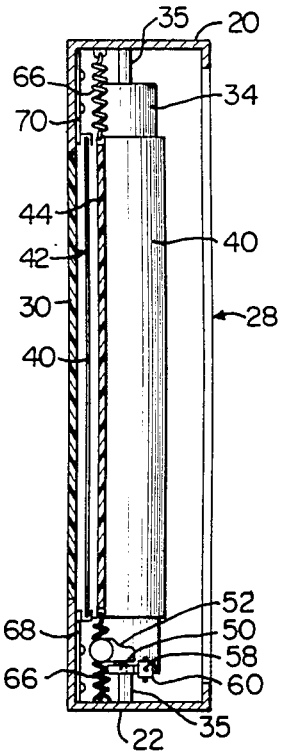
FIG. 4 is a cross-sectional view taken about lines 4—4 of FIG. 2.
Figure 3:
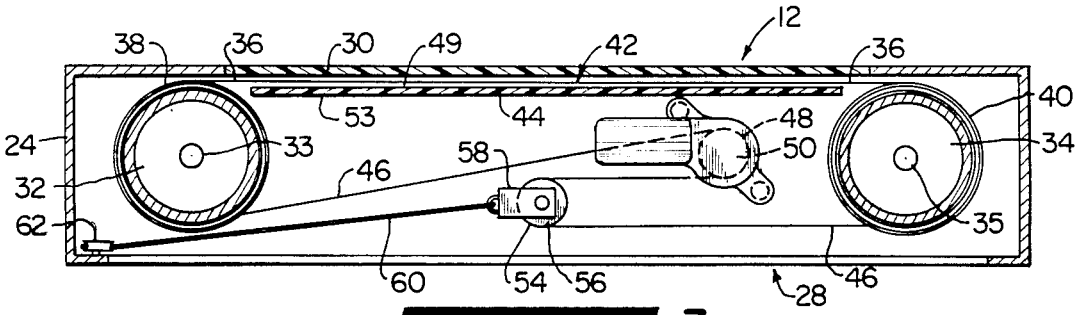
FIG. 3 is a cross-sectional view taken about lines 3—3 of FIG. 2.
Figure 5:
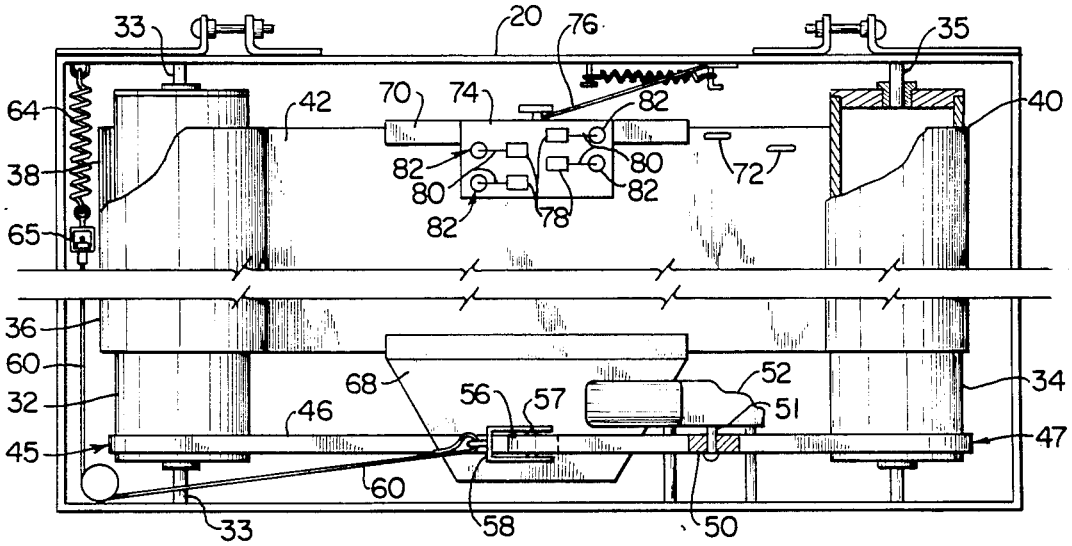
FIG. 5 is a rear view in elevation, partially broken away, of the scroll module shown in FIG. 2.

Color panel 44 is preferably a laminate flexible panel formed by an ultraviolet enhanced, translucent vinyl 49 adhered to a transparent plastic substrate 53. The color panel 44 is resiliently mounted between top wall 22 and bottom wall 24 of framework 18 by a plurality of springs 66 as is best shown in FIG. 4. Springs 66 maintain tension across panel 44 to keep it taut, and further serve to compensate for relative expansion and contraction of panel 44 due to temperature change. Message web 36 is preferably a transparent medium which is silkscreened to form transparent message characters on an opaque backgroun. Naturally, other combinations of characters and backgrounds are within the scope of this invention; however, this preferred form allows the message character to take on the color of color panel 44. Panel 44 is releaseably mounted by springs 66 and, thus, the color panels may be removed and replaced with a different color panel by the user at a nominal cost. Further, by laminating a transparent plastic with a thin film of vinyl substantially reduces the cost of color panel 44, especially where the panel is ultraviolet light enhanced, that is, impregnated with a phosphorescent material.

Message web 36 is mounted between a lower guide 68 and an upward guide 70 to align web 36 so that it does not move laterally of its path of movement from movement between rollers 32 and 44. Message web 36 is indexed along its upper edge, such as by index openings 72 which pass index reading element 74 which automatically monitors web 36 in order to automatically control the message displayed through front face 30. Index reading structure 74 is mounted by bracket assembly 76 to top wall 20 and includes a plurality of microswitches 78, each of which having a feeler finger 80 oriented to sense openings 72 through respective holes 82 in plate 84. Microswitches 78 are then connected through suitable wiring harnesses to electronic control 86. Electronic control 86 thus monitors switches 78 and operates motor 52 to drive web 36 to a desired location. Thus, the control automatically operates the drive motor in an intermittent manner to display a selected message at the view area. According to the state of the art, a single microswitch could be employed and a microprocessor counter utilized to count electrical pulses in order to monitor the message web.

As noted above, tensioning spring 64 applies tensioning force to strap 46, rollers 32, 34 and message web 36. It should be appreciated that this tensioning force is important due to the changes in diameters of the message web windings about rollers 32 and 34 as well as the diameters of the end portions 45 and 47 of drive strap 46 on rollers 32 and 34. The effect that the changing diameters has upon the drive system and tensioning system is diagrammed in FIGS. 6A, 6B and 6C.

Figure 6A:
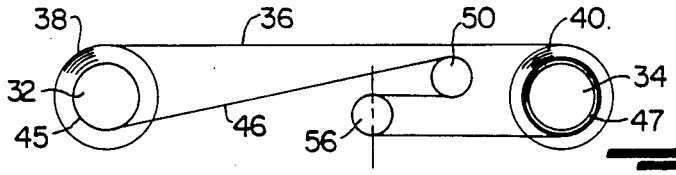
FIGS. 6A, 6B and 6C are diagrammatic views of the roller and drive band assembly according to the preferred embodiment of the present invention.
Figure 6B:
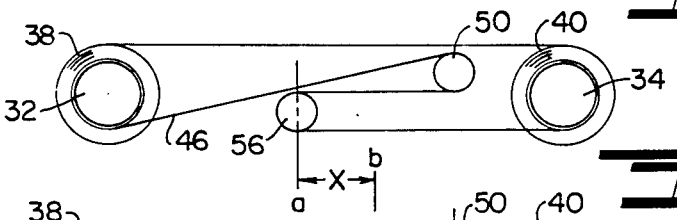

In FIG. 6A, very little of message band 36 is wound around roller 34 so that there is a substantial end portion 38 of message band 36 wound about roller 32. Correspondingly, a substantial amount of strap 46 is wrapped about roller 34 as end portion 47 with very little of strap 46 being wound as end portion 45 about roller 32. This represents one extreme condition as noted by position "a" of tensioning pulley 56. As the message band 36 and drive strap 46 are driven in the direction shown by the arrows, the changing diameters of end portions 45, 47 of strap 46 and 38, 40 of web 36 are such that the length of the unwound strap portion of strap 46 increases. Tensioning spring 64 thus compensates for this increased length by moving tensioning pulley 56 to the left, as is shown in FIG. 6B, a distance "x" until it reaches a second extreme position at "b" that corresponds to a state wherein end portions 38 and 40 as well as end portions 45 and 47 are equal.

Figure 6C:
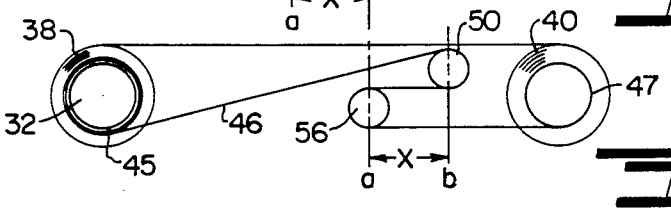

As web 36 and strap 46 are continued to be driven, roller 56 moves to the right until it again reaches location a that corresponds to the position shown in FIGS. 6C. This extreme position is the same as that shown in FIG. 6A except that there is very little of strap 46 wound about roller 34 while end portion 45 of strap 46 s substantial. Likewise, end portion 38 of web 36 has diminished to the minimum while there is a substantially greater end portion 40 wound about roller 34. Accordingly, it should be appreciated that the tensioning of pulley 56 both compensates for this change in band 46 while, at the same time, maintains exposed portion 42 of web 36 in a taut and neat appearance.

Figure 7:
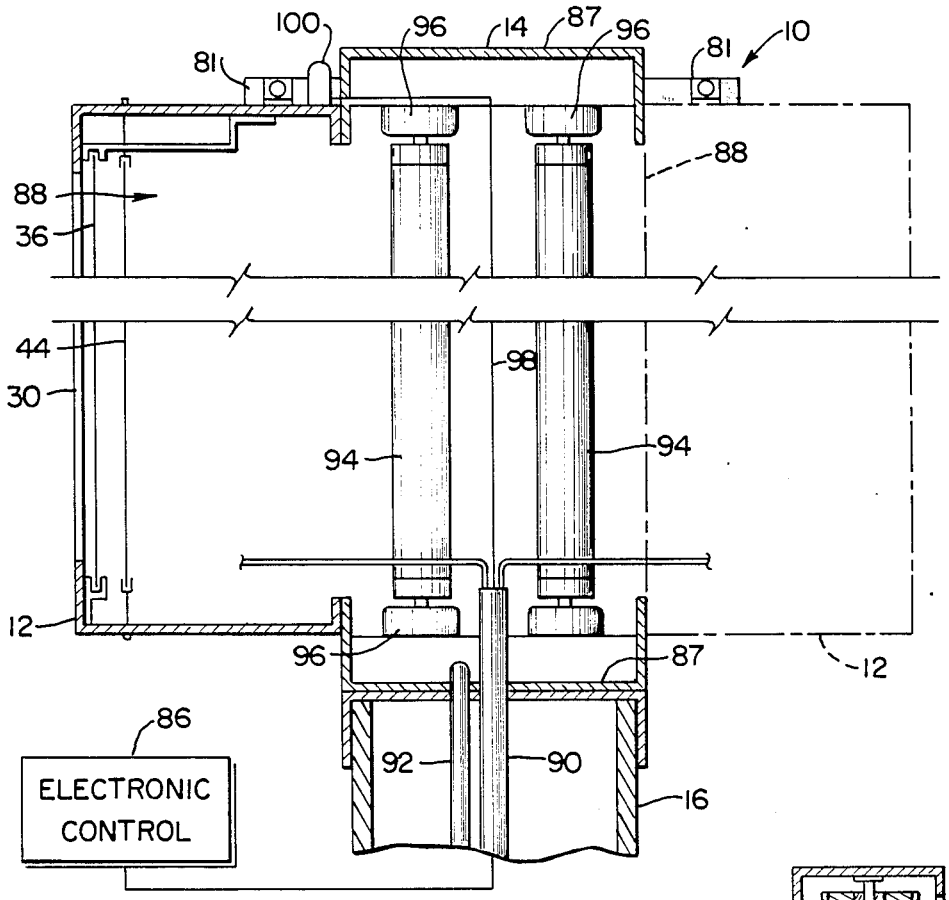
FIG. 7 is a cross-sectional view of the display sign assembly shown in FIG. 1.

As noted above, a plurality of modules 12 may be mounted to form a sign display 10 with sign display 10 being best shown in FIGS. 1 and 7. As is shown in FIG. 7, a pair of modules 12 are mounted by means of mounting brackets 81 to a central housing 14. Central housing 14 is defined by a peripheral wall 87 and includes oppositely facing view windows or openings 88. Housing 14 is supported by a hollow pole 16 which carries the electrical conduits 90 and 92 which operate sign display 10. To this end, conduit 90 carries power to drive motors 52 in each module 12 as well as the wiring for index readers 74. Conduit 92 carries electrical power to a light source mounted in central housing 14 with this light source being defined by fluorescent lights 94 extending between sockets 96 mounted to peripheral wall 87. In addition, conduit 90 may carry a wire 98 connected to a photocell 100 so that electronic control 86 may monitor ambient light in order to automatically activate and deactivate lights 94.

It should be appreciated that open backs 28 of modules 12 are thus mounted over corresponding openings 88 of housing 14 so that light from lights 494 may radiate outwardly and pass through each of the transparent pressure plates 44 to illuminate each message web 36 for viewing through front face 30. Conduit 90 carries the electrical connections for each of index reading structure 74 as well as the power supply for each of drive motors 52. Further, housing 14 could be an enclosed structure into which modules 12 are inserted. In such case, the housing 14 would have a transparent window covering over each view window adjacent the front of the module; in this structure, the need for transparent face 30 on module 12 would be eliminated. Thus, it is within the scope of this invention to construct module 12 without face 30, so that the module is open forwardly of exposed portion 42, and to employ an enclosed housing 14 into which one or more modules can be inserted.

Figure 8:
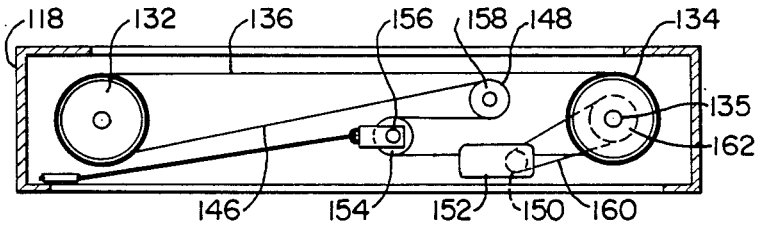
FIG. 8 is a cross-sectional view of an alternate embodiment of the module shown in FIG. 2 showing an alternate drive assembly.

An alternate drive system to that described above, is diagrammed in FIG. 8. In FIG. 8, drive motor 152 does not directly engage drive strap 146 but rather drives roller 134 by means of a drive belt 160 which extends around a pulley 162 on axle 135 of roller 134. Drive belt 160 is trained around drive wheel 150 that is driven by motor 152 so that rotation of roller 134 drives both message web 136 and drive strap 146, and thus roller 132. To provide tensioning for the system shown in FIG. 8, a stationary pulley 158 is rotatably journaled on framework 118 and receives a looped portion 148 of strap 146. A second looped portion 154 of strap 146 extends around tensioning pulley 156, and a cable and spring tensioning assembly biases tensioning pulley 156 in a manner corresponding to that described with respect to the preferred embodiment of the present invention.

Figure 9:
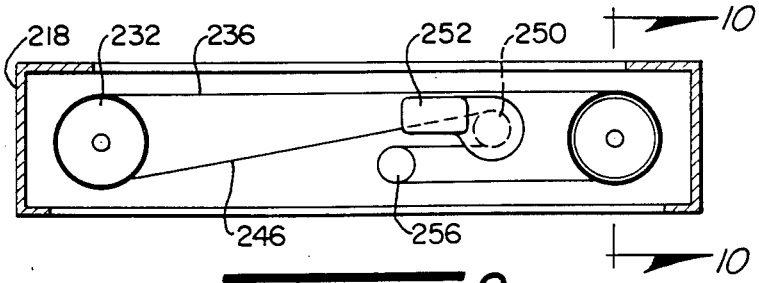
FIG. 9 is a cross-sectional view of a message roller showing an alternate embodiment of a tensioning assembly from that shown in FIGS. 2 and 3.
Figure 10:
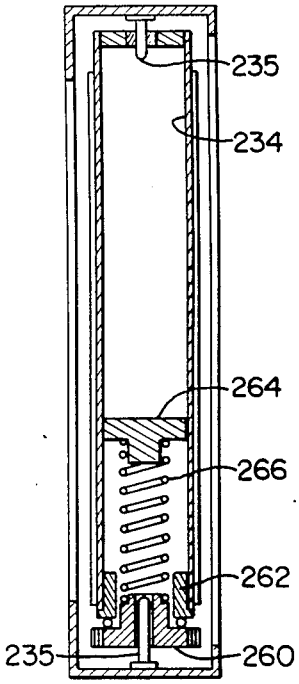
FIG. 10 is a cross-sectional view taken about lines 10—10 of FIG. 9.

FIGS. 9 and 10 show an alternative tensioning system to that described with respect to the preferred embodiment of the present invention. Here, the assembly is the same as that described with respect to the preferred embodiment except that both drive wheel 250 and pulley 256 are stationary with respect to framework 218 with drive strap 246 being trained around each of these pulleys. Drive motor 252 directly engages drive strap 246. In this assembly, as is shown in FIG. 10, tensioning structure is located internally of hollow roller 234 with this tensioning assembly operative to both take up the slack in drive strap 246 and message web 236 due to the changes in winding radii, as discussed above.

To this end, a spring mounting block 260 rotatably receives trunnion pin 235 and a bearing 262 is mounted between block 260 and roller 234 so that roller 234 may rotate on an axis defined by pin 235 about bearing 262. A second spring block 264 is rigidly secured to roller 234 on the interior thereof and a spring 266 is mounted between blocks 260 and 264. This spring 266 is pretorqued during construction so as to maintain a force tending to wind web 236 onto roller 234.

Drive strap 246 is wound around block 260 and thus drives roller 234 through spring 266. Thus, as the message web 236 is wound from roller 232 onto roller 234, and back again, spring 266 moves between increased and decreased torque. However, since torque is always present on spring 266, even in the minimum torque condition, spring 266 keeps the exposed portion 242 of web 236 taut. Any slack that would normally be present on drive cable 246 is removed by spring 266 drawing web 236 around roller 234 thus tightening strap 246 against drive wheel 250.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. A scrolling apparatus for displaying changeable messages and adapted for use as an internally illuminated outdoor sign, comprising:

a box-like framework having a front view area adapted to allow viewing of a selected message;

a pair of rollers journaled for rotation in the interior of said framework and located at opposite sides of said view area on substantially parallel, spaced-apart axes;

a flexible message web having opposite end edges secured to a respective roller and having end portions wound around said rollers whereby an exposed portion of the web extends between rollers across said view area and whereby rotation of the rollers causes the web to be wound from one roller to the other roller to change the exposed portion thereof;

a flexible drive strap having a first end mounted to one of said rollers and a second end mounted to the other of said rollers and having end portions wound around said rollers whereby rotation of the rollers causes the strap to be wound from one roller onto the other roller, the end portion of the strap on each roller being wound around its respective roller in an opposite circumferential direction than the web, said strap having a width substantially larger than its thickness whereby each end, portion thereof is wrapped and unwrapped directly about itself on its respective roller;

tensioning means on a web drive assembly defined by said rollers and said drive strap for applying a rotational tensioning force to the web whereby the exposed portion of the web is maintained taut under the force of said tensioning means; and drive means for reverseably driving the drive assembly to wind the web from one roller to the other roller.

2. A scrolling apparatus according to claim 1 wherein said message web having light transmissive portions and including a color panel resiliently mounted in said framework on a side of the exposed portion of said web opposite the view area so that the light transmissive portions of the message web appear to have the color of the color panel.

3. A scrolling apparatus according to claim 2 including illumination means for lighting the interior of said framework, said color panel being constructed of a material that permits transmission of light therethrough whereby the exposed portion of the web may be backlit.

4. A scrolling apparatus according to claim 3 wherein the color panel is translucent and is treated to be ultraviolet light enhanced.

5. A scrolling apparatus according to claim 1 including a first guide means along one edge of the exposed portion of the web and a second guide means along the other edge of the exposed portion of the web for guiding the tracking of the web as it is wound from one roller to the other.

6. A scrolling apparatus according to claim 1 wherein the message web has index markings corresponding to the exposed portion thereof and including index reading means for sensing the index markings.

7. A scrolling apparatus according to claim 6 wherein said index markings comprise perforations along one edge of the exposed portion of the web, said index reading means including a follower finger biased to engage said perforations and to operate electrical contacts in response to said perforations.

8. A scrolling apparatus according to claim 6 including control means for monitoring said index reading means and for intermittently operating the drive means.

9. A scrolling apparatus according to claim 8 wherein said control means includes memory means for correlating a plurality of messages on said web to the index markings whereby the control means may automatically operate said drive means to wind the web to a position such that the exposed portion of the web has a selected message viewable through said front face.

10. A scrolling apparatus according to claim 1 wherein said tensioning means includes a spring inside one of said rollers, said spring having a first end portion fixed relative to the end of the drive strap mounted to said one of said rollers and a second end portion fixed relative to the one roller whereby rotation of the one roller in a first direction increases the restorative force of said spring.

11. A scrolling apparatus according to claim 10 wherein the spring is pre-torques to be mounted with at least some restorative force tending to rotate the message web relative to the drive strap.

12. A scrolling apparatus according to claim 1 wherein said tensioning means includes a pair of rotatable pulleys receiving looped portions of said drive strap, a first pulley having an axle fixed relative to said framework and a second pulley having an axle relatively moveable with respect to the framework, and a spring bias means for applying force to the second pulley axle to lengthen the looped portion around the second pulley.

13. A scrolling apparatus according to claim 12 wherein said second pulley axle is connected to said framework only through said spring bias means whereby the second pulley floats relative to the framework.

14. A scrolling apparatus according to claim 13 including adjustment means on said spring bias means for selectively adjusting the force applied thereby.

15. A scrolling apparatus according to claim 12 wherein said drive means directly drives said first pulley to drive said drive strap.

16. A scrolling apparatus according to claim 12 wherein said drive means drives one of the rollers independently of said first and second pulleys.

17. A scrolling apparatus according to claim 1 wherein said view area is defined by a transparent front face panel.

18. A scrolling apparatus according to claim 1 wherein said view area is an opening in the framework.

19. A sign assembly for displaying changeable messages, comprising:

a central housing having a peripheral wall and first and second oppositely facing view windows;

a light source mounted in said central housing;

at least two message modules, one module being adjacent each view window, each module being formed of a box-like framework having an open back and a front view area adapted to allow viewing of a selected message, said modules each positioned such that light from said light source passes through its open back toward its front view area;

a pair of rollers journaled for rotation in each module, said rollers having spaced-apart, substantially parallel axes therein;

a message web in each said module, each message web having opposite end edges secured to a respective roller and having opposite end portions wound around its respective pair of rollers with an exposed portion being trained along th front view area of its module in the path of light from the light source and whereby rotation of the rollers causes the web to be wound from one roller to another to change the exposed portion thereof;

a drive strap in each module operative with the web to rotate its respective rollers, each drive strap having a width substantially larger than its thickness strap having a width secured to the rollers and having end portions thereof wound around said rollers whereby rotation of the rollers causes the strap to be wound from one roller to the other roller in a manner such that each end portion of the strap is wrapped and unwrapped directly about itself, the end portions of the strap being wound in a circumferential direction on each roller opposite the direction of the web winding;

tensioning means in each module for applying a rotational restorative force on one of the pair of rollers whereby the exposed portion of the web is maintained taut; and drive means in each module for reversibly driving the pair of rollers therein to reversibly wind the web from one roller to the other roller.

20. A sign assembly according to claim 19 wherein each said message web having light transmissive portions and each said module including a color panel resiliently mounted in said framework on a side of the exposed portion of said web opposite the front view area so that the light transmissive portions of the message web appear to have the color of the color panel.

21. A sign assembly according to claim 19 wherein each said tensioning means includes a pair of rotatable pulleys receiving looped portions of said drive strap, a first pulley having an axle fixed relative to said framework and a second pulley having an axle relatively moveable with respect to the framework, and a spring bias means for applying force to the second pulley axle to lengthen the looped portion around the second pulley.

22. A sign assembly according to claim 21 wherein each said second pulley axle is connected to its respective frameowrk only through its said spring bias means whereby the second pulley floats relative to its framework.

23. A sign assembly according to claim 22 including adjustment means on each said spring bias means for selectively adjusting the force applied thereby.

24. A scrolling apparatus for displaying changeable messages and adapted for use as an internally illuminated outdoor sign, comprising:

a box-like framework having a front view area adapted to allow viewing of a selected message;

a pair of rollers journaled for rotation in the interior of said framework and located at opposite sides of said view area on substantially parallel, spaced-apart axes;

a flexible message web having opposite end edges secured to a respective roller and having end portions wound around said rollers whereby an exposed portion of the web extends between rollers across said view area and whereby rotation of the rollers causes the web to be wound from one roller to the other roller to change the exposed portion thereof;

a color panel mounted for resilient mounting elements in said framework on a side of the exposed portion of the web opposite the view area;

a flexible drive strap having a first end mounted to one of said rollers and a second end mounted to the other of said rollers and having end portions wound around said rollers whereby rotation of the rollers causes the strap to be wound from one roller to the other roller, the end portion of the strap on each roller being wound around its respective roller in an opposite circumferential direction than the web;

tensioning means on a web drive assembly defined by said rollers and said drive strap for applying a rotational tensioning force to the web whereby the exposed portion of the web is maintained taut under the force of said tensioning means; and drive means for reverseably driving the drive assembly to wind the web from one roller to the other roller.

25. A scrolling apparatus according to claim 24 wherein said message web having light transmission portions whereby the light transmissive portions of the message web appear to have the color of the color panel.

26. A scrolling apparatus according to claim 24 including illumination means for lighting the interior of said framework, said color panel being constructed of a material that permits transmission of light therethrough whereby the exposed portion of the web may be backlit.

27. A scrolling apparatus according to claim 26 wherein the color panel is translucent and is treated to be ultraviolet light enhanced.

* * * * *